US006554581B2

(12) United States Patent
Hinrichs et al.

(10) Patent No.: US 6,554,581 B2
(45) Date of Patent: Apr. 29, 2003

(54) AIR CONDITIONING COMPRESSOR

(75) Inventors: Jan Hinrichs, Friedrichsdorf (DE); Frank Obrist, Dornbirn (AT); Peter Kuhn, Weinheim (DE); Volker Seipel, Bensheim (DE)

(73) Assignee: Luk Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 09/991,276

(22) Filed: Nov. 21, 2001

(65) Prior Publication Data

US 2002/0076342 A1 Jun. 20, 2002

Related U.S. Application Data

(63) Continuation of application No. PCT/DE00/01652, filed on May 23, 2000.

(30) Foreign Application Priority Data

May 26, 1999 (DE) ..... 299 23 375 U

(51) Int. Cl.[7] ..... F04B 1/12
(52) U.S. Cl. ..... 417/269; 417/572
(58) Field of Search ..... 417/269, 572; 92/71; 91/499, 503

(56) References Cited

U.S. PATENT DOCUMENTS

| | | | | |
|---|---|---|---|---|
| 3,577,891 A | | 5/1971 | Nemoto et al. | |
| 4,073,603 A | | 2/1978 | Abendschein et al. | |
| 4,095,921 A | | 6/1978 | Hiraga et al. | |
| 5,167,181 A | * | 12/1992 | Lee | 417/269 |
| 5,630,707 A | * | 5/1997 | Kim et al. | 417/269 |
| 6,368,071 B1 | * | 4/2002 | Hashida et al. | 417/269 |

FOREIGN PATENT DOCUMENTS

| | | |
|---|---|---|
| DE | 198 08 251 A1 | 9/1998 |
| DE | 198 07 947 A1 | 11/1998 |

* cited by examiner

*Primary Examiner*—Charles G. Freay
(74) *Attorney, Agent, or Firm*—Alston & Bird LLP

(57) ABSTRACT

A compressor for the air conditioning system of an automobile, having a housing and a compressor unit arranged in the housing for taking in and compressing a refrigerant. The refrigerant flows from an intake area through the compressor unit into a discharge area likewise formed in the housing cover, and the housing cover sealingly connects to the housing via connecting members. For reducing a load on the connecting members, the connecting area, through which the connecting members extend, is at least substantially separated from the pressure generated within the compressor.

11 Claims, 1 Drawing Sheet

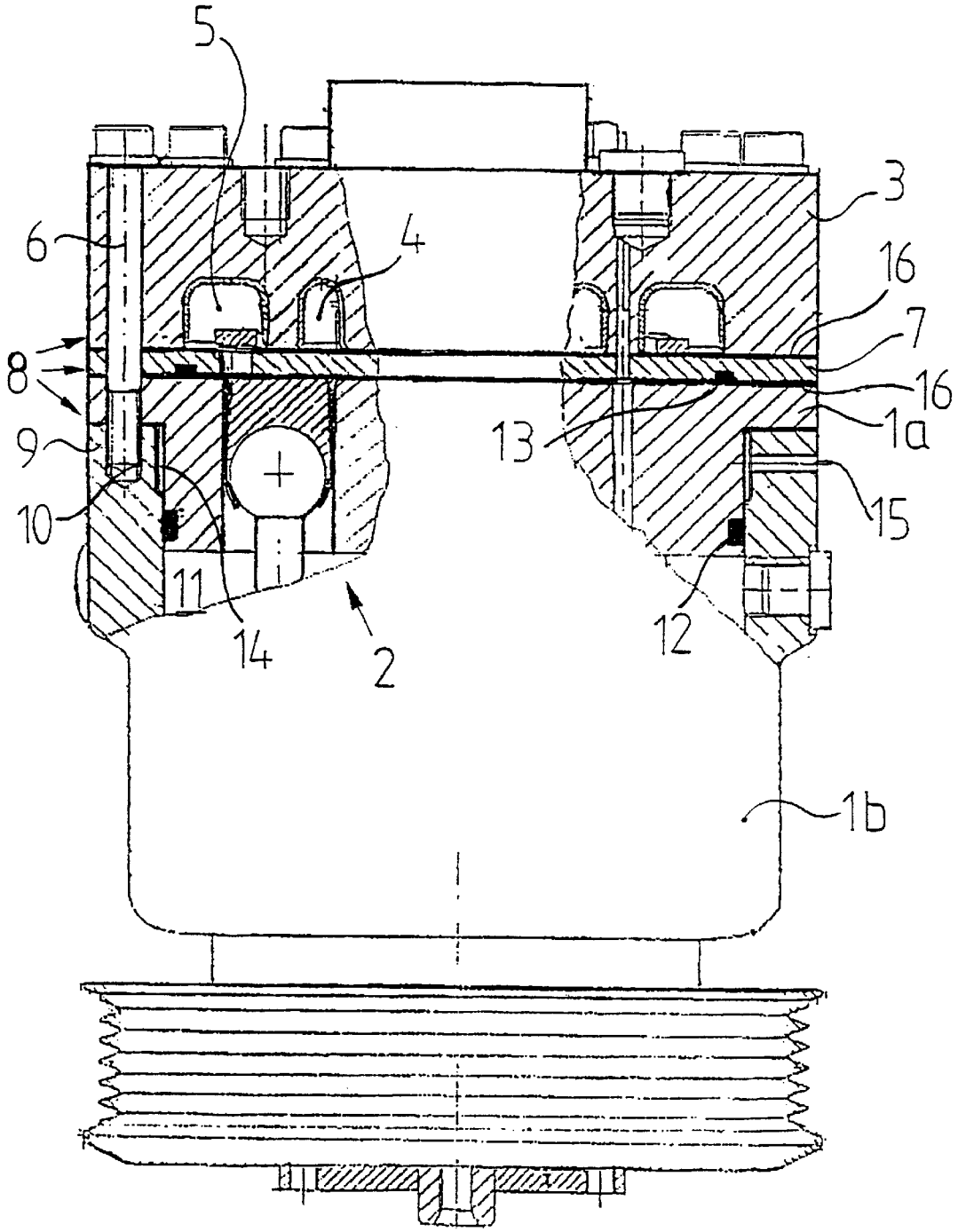
Fig.

AIR CONDITIONING COMPRESSOR

CROSS-REFERENCE TO RELATED APPLICATION

This is a continuation of international application PCT/DE00/01652, filed May 23, 2000, and designating the U.S.

BACKGROUND OF THE INVENTION

The invention relates to a compressor, in particular for use in the air conditioning system of an automobile, having a housing and a compressor unit accommodated in the housing for taking in and compressing a refrigerant. The refrigerant flows from an intake area in the housing cover through the compressor unit into a discharge area likewise formed in the housing cover, and the housing cover is sealingly connected to the housing via connecting members.

Compressors of the type described above are commonly referred to as air conditioning compressors and are known from practice in a large variety of configurations. Such compressors comprise a housing, which encloses an externally driven compressor unit or pump unit. The pump unit, which is designed and constructed, for example, as an axial piston pump, in turn comprises at least one piston, which is adapted for reciprocal movement in a cylinder block. Normally, such a compressor is provided with a plurality of pistons, which are reciprocated during the rotation of a swash plate via a receiving disk in the direction of their longitudinal axis, the receiving disk being supported for corotation in the housing.

In addition to conventional refrigerants, whose use appears to be more and more critical in the light of an increasing awareness of the environment, it is possible to use as the refrigerant an inert gas, for example, $CO_2$, which is noncritical under environmental aspects. The use of such a refrigerant, however, requires higher pressures within the compressor, thereby necessitating very special constructional measures, for example, with respect to selecting material and dimensioning.

Normally, the housing cover is releasably joined to the housing of the compressor unit, with a valve plate being arranged therebetween. In particular in the case of $CO_2$ compressors, which operate under high pressures, the connecting members are subjected to considerable stress as a result of the pressures prevailing in the interior of the housing. Thus, the enormous pressures occurring in the compressor unit or in the drive chamber, namely, pressures ranging from 40 bars to 60 bars, may lead to deformations of the connecting members, so that leakages result at the joint between the housing and housing cover. In this respect, conventional compressors make it necessary to provide additional, external sealing measures to be able to compensate at least slight deformations of the connecting members for avoiding leakages. This requires a more extensive constructional expenditure, and is inadequate to achieve the desired result.

It is therefore an object of the present invention to improve and further develop a compressor of the initially described kind such as to reduce the load on the connecting members that join the housing cover to the housing. Furthermore, it is intended to avoid at least to a greatest extent a pressure load on the connecting members resulting from internal leakages.

SUMMARY OF THE INVENTION

The above and other objects and advantages of the invention are achieved by the provision of a compressor wherein the connecting area, through which the connecting members which join the cover to the housing extend, is at least substantially separated from the high pressures generated in the compressor.

In accordance with the invention, it has been discovered that a load on the connecting members, in particular as a result of internal leakages, will be avoided at least to a large extent, when the connecting area is relieved from pressure. In other words, in the ideal case, the connecting area comprising the connecting members should be made pressure free, so that except for the axial load on the connecting members, no further load will occur, in particular there are no bending forces.

Advantageously, the connecting members extend through the housing cover into a peripheral wall of the housing. Also, a plurality of connecting members preferably are provided in equidistant relationship with one another along the circumference of the housing cover. Specifically, the connecting members could be screws, which totally extend through the housing cover, and engage with their external screw thread bores that are formed with a corresponding internal screw thread in the wall of the housing. When fastening or tightening the screws, the screw head comes to lie against the surface of the housing cover. This permits securing the housing cover to the housing in a sealing manner.

The pressure relief as further provided by the present invention could be realized by an inner seal against the outer connecting area, so as to ensure that the connecting area comprising the connecting members is more or less pressure free. Additional external sealing measure are not needed in the case of such an inner seal. Quite the contrary, the outer connecting area could include desired leakages toward the exterior, to be able to ensure to this extent likewise a further pressure relief in the case that an internal leakage occurs.

Seals may be arranged between the connecting area and the high pressure zone, both in the housing cover and in the housing. In the area, which is here referred to as the high-pressure zone, the drive chamber pressure is prevalent. Depending on the controlled position, this pressure is understood to be the intermediate pressure between the high pressure and the suction pressure. In this connection, it would be possible to seal the connecting area against the drive chamber or compressor unit, so that the connecting area is relieved from pressure or even free of pressure. In a further advantageous manner, the connecting area is likewise sealed against the high pressure zone in the housing cover. If a valve plate is provided between the housing or compressor unit and the housing cover, it will be of further advantage, when the connecting area is sealed against the valve plate, so that no pressure load may reach the connecting area either from the high pressure side inside the housing or from the high pressure side inside the housing cover.

The seals may be any desired rubber gaskets, for example, O-rings. Other conventional sealing measures are possible.

Furthermore with respect to a purposeful pressure relief of the connecting area, it will be of further advantage, when a pressure relieved space is formed between the connecting area and the compressor unit or drive chamber. This pressure relieved space preferably extends annularly around the compressor unit, and is provided in the vicinity of the engagement between the connecting members or screws and the housing peripheral wall. This space is suitable for compensating possible leakages from within the housing or from the drive chamber, at least to the extent that so-called creep pressures do not occur and act upon the connecting members to their full extent.

Furthermore, it will be of advantage, when the pressure relieved chamber is sealed against the compressor unit or against the drive chamber.

For a more extensive pressure relief of the space, primarily, however, of the connecting members, it will be of further advantage to provide at least one vent channel extending from the space toward the exterior of the housing, so that undesired leakages are able to escape from the space to the atmosphere, without forming pressure cushions relative to the connecting members, and thus having a negative effect.

There exist various possibilities of improving and further developing the teaching of the present invention in an advantageous manner. To this end, one may refer to the following description of an embodiment of the invention with reference to the drawing. In conjunction with the description of the preferred embodiment of the invention with reference to the drawing also generally preferred improvements and further developments of the teaching are described in greater detail.

BRIEF DESCRIPTION OF THE DRAWING

The single drawing FIGURE is a schematic side view, partial and sectioned, of an embodiment of a compressor according to the invention, and showing only the essential features with respect to the claimed teaching.

DETAILED DESCRIPTION OF THE PREFERRED EMBODIMENT

The drawing shows a compressor for the air conditioning system of an automobile. The compressor comprises a housing 1*b* and a conventional compressor unit 2 arranged in the housing 1*b* for taking in and compressing a refrigerant, with the refrigerant typically being $CO_2$.

The refrigerant flows from an intake area 4 formed in a front end housing cover 3 through the compressor unit 2 into a discharge area 5 likewise formed in the housing cover 3.

As can further be noted from the drawing, the housing cover 3 is sealingly connected to the housing 1*b* via connecting members 6. Furthermore, between the housing cover 3 and housing 1*b*, a cylinder block la and a valve plate 7 are provided, which are not described in greater detail.

In accordance with the invention, a connecting area 8, through which the connecting members 6 extend, is at least largely relieved from pressure, namely in the region between a seal 12 arranged between the connecting area and drive chamber and a pressure-relieved space 14. In this connection, a pressure relief is to be understood to be with respect to the pressure generated within the compressor, namely the pressure in the drive chamber.

As can further be noted from the drawing, the connecting members 6 are formed as screws, with the drawing showing a sectional view of only one of the screws. The screws or connecting members 6 extend through the housing cover 3 into a peripheral wall 9 of the housing 1*b*. Along the circumference of the housing 1*b*, a plurality of connecting members or screws 6 are provided in equidistant relationship with one another. The screws 6 extend through bores in a mounting flange of the cylinder block 1*a*, and the valve plate 7, and the external screw threads of the screws engage bores 10 provided with internal screw threads in the wall 9 of housing 1*b*, thereby permitting them to be tightened, so that the housing cover 3 is adapted for being tightly secured to the housing 1*b*.

As can further be noted from the drawing, a pressure relief is realized by inner seals against the outer connecting area 8. Specifically, seals are arranged between the connecting area 8 and a high pressure zone, on the one hand in the drive chamber and on the other hand in the housing cover 3, with the connecting area 8, in this instance, a pressure relieved connecting area, being sealed against the drive chamber 11 or the compressor unit 2 by members of a seal 12. The seal preferably is an O-ring. The pressure relieved connecting area is understood to include the region indicated at numeral 8 and by the there lowest arrow, as well as the wall 9 of housing 1*b*.

Furthermore, it should be noted that between the housing cover 3 and the valve plate 7, a flat packing 16 is arranged. The valve plate consists of a seat plate and a suction lamella with individual pressure lamellae, which are arranged in the discharge area 5. The seat plate is sealed against the suction lamella by members of an O-ring. The suction lamella is sealed against the cylinder block 1*a* by members of a flat packing.

A further seal 13 is provided between the connecting area 8 and the valve plate 7, so that the connecting area 8 is already at least largely relieved from pressure by the there provided seals 12, 13 or sealing measures.

As a further measure for relieving pressure from the connecting area 8 as well as the wall 9 of housing 1*b*, the pressure relieved space 14 is provided between the connecting area 8 and the compressor unit 2 or the drive chamber 11. This pressure relieved space extends annularly around the compressor unit 2. For discharging internal leakages, and thus for preventing a high pressure from developing inside the space 14, a vent channel 15 is provided as a further measure for relieving the pressure. This vent channel extends from the space 14 to the outside of housing 1*b*. With that, a load on the connecting members or screws resulting from creep pressures is largely avoided, which assists the service life of the compressor.

Finally, it should be expressly noted that the foregoing embodiment serves to describe merely the claimed teaching, without however limiting it to the embodiment. Furthermore, it should be noted that while any desired combination of the above-described features is possible, a here randomly selected combination of features is not mandatory.

What is claimed is:

1. A compressor for use in an air conditioning system and comprising a housing, a housing cover mounted to the housing and defining a refrigerant intake and a refrigerant discharge, a compressor unit arranged in the housing for taking in and compressing a refrigerant flowing into the housing via the intake and then discharging the compressed refrigerant through the discharge, said housing cover being joined to the housing at a connecting area which includes a plurality of connecting members which interconnect the cover and the housing, with said connecting area being at least substantially separated from the high pressure which develops in the housing by at least one internal seal arranged between the connecting area and the interior of the housing, wherein said connecting area includes an outer peripheral wall formed on said housing, and said connecting members extend through said cover and into said peripheral wall, further comprising a cylinder block which has a mounting flange clamped between said peripheral wall and said cover, with said connecting members extending through bores in said mounting flange, and further comprising a valve plate arranged between the mounting flange of the cylinder block and said cover, with said connecting members extending through bores in said valve plate.

2. The compressor as defined in claim 1 wherein the plurality of connecting members are disposed in an equidistant spaced relationship about the circumference of the peripheral wall of the housing.

3. The compressor as defined in claim 2 wherein the connecting members comprise screws which engage internally threaded bores in the peripheral wall of the housing.

4. The compressor as defined in claim 1 wherein the connecting area is separated from the high pressure which develops in the cover by an internal seal arranged between the connecting area and the interior of the cover.

5. The compressor as defined in claim 1 wherein the at least one internal seal comprises an O-ring.

6. The compressor as defined in claim 1 wherein a pressure relieved space is formed between the connecting area and the interior of the housing.

7. The compressor as defined in claim 6 wherein the compressor unit defines a central axis and wherein the pressure relieved space extends annularly about the central axis.

8. The compressor as defined in claim 7 wherein the annular pressure relieved space is sealed from the interior of the housing by said at least one seal.

9. The compressor as defined in claim 8 wherein the annular pressure relieved space is vented to the outside atmosphere.

10. The compressor as defined in claim 1 wherein the at least one internal seal comprises a seal between the peripheral wall of the housing and the cylinder block, and a further comprising a seal between the cylinder block and the valve plate.

11. The compressor as defined in claim 10 further comprising a seal between the valve plate and the cover.

* * * * *